United States Patent [19]

Frank

[11] Patent Number: 4,686,897

[45] Date of Patent: Aug. 18, 1987

[54] HYDRAULIC BENCH PRESS

[76] Inventor: Paul C. Frank, Box 23, Halkirk, Alberta, Canada, T0C 1M0

[21] Appl. No.: 857,483

[22] Filed: Apr. 30, 1986

[30] Foreign Application Priority Data

May 9, 1985 [CA] Canada ..... 481122

[51] Int. Cl.[4] ..... B30B 1/32

[52] U.S. Cl. ..... 100/214; 100/231; 100/266; 100/257; 100/269 R

[58] Field of Search ..... 100/99, 214, 231, 266, 100/269 R, 257, 295, 270; 29/251

[56] References Cited

U.S. PATENT DOCUMENTS 2,439,725 4/1948 Frost ..... 100/257 X
3,011,750 12/1961 Johnson ..... 100/270 X
3,307,830 3/1967 Van Allen ..... 100/257 X
3,495,527 2/1970 Lafreniere ..... 100/269 R X

*Primary Examiner*—Peter Feldman
*Attorney, Agent, or Firm*—S. G. Ade; A. D. Battison

[57] ABSTRACT

A supporting frame includes a pair of press bars adjustable fore and aft and being positionable in an upper or lower position relative to the frame. A hydraulic press head assembly is supported above the press bars and is manually operable to engage a work piece supported by the press bars. The hydraulic press head assembly includes a manually operated pump, a release valve, a relief valve and an oil reservoir all supported upon the upper end of a press frame. The entire assembly is designed to be supported on a conventional work bench or on its own work bench as desired.

20 Claims, 4 Drawing Figures

HYDRAULIC BENCH PRESS

BACKGROUND OF THE INVENTION

This invention relates to new and useful improvements in hydraulic bench presses, particularly bench presses which are usable in a farm workshop, garage, service station or small machine shop.

Conventionally, such presses are relatively large floor models generally suited for relatively heavy duty work not normally required in relatively small shops as mentioned above.

The present invention overcomes disadvantages inherent with such large presses by providing a relatively small but extremely efficient and strong bench press assembly which can be bolted to a conventional work bench or, alternatively can be self-supported upon its own bench if desired under which circumstances portability may well be incorporated into the assembly.

SUMMARY OF THE INVENTION

It consists primarily of a manually operated hydraulic press head supported in supporting frame work attached to the bench and having a pair of press bars situated below the press head which firstly can be adjusted fore and aft on the supports and secondly can be located on an uppermost or lowermost position thus giving considerable flexibility as to the size of the work piece upon which the bench press may operate. Furthermore, these press bars are detachably securable in either of the uppermost or lowermost positions so that inadvertent displacement thereof cannot take place.

In accordance with the invention there is provided a hydraulic press for attachment to a supporting surface such as a bench; comprising in combination supporting structure, said supporting structure including a main frame consisting of a pair of spaced and parallel press bar supports, a press frame secured to adjacent and rear ends of said press bar supports and extending upwardly therefrom, a manually operated hydraulic press assembly supported upon the upper end of said press frame and a pair of press bars operatively situated upon said press bar supports below said press assembly.

Another advantage of the invention is that it is relatively simple in construction, economical in manufacture and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
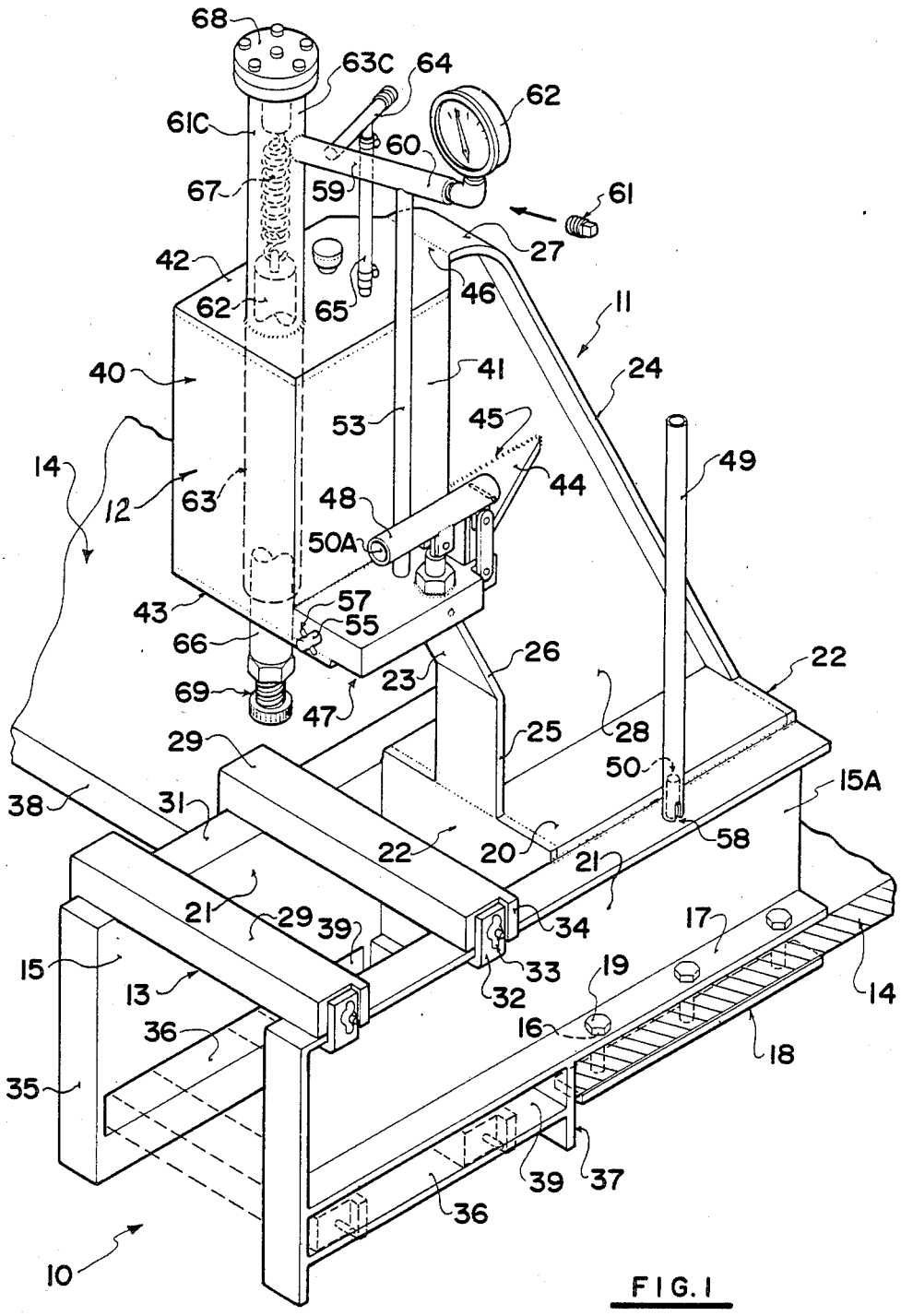
FIG. 1 is an isometric view of the invention.

In general, the invention consists of supporting structure collectively designated 10, a press frame collectively designated 11, a hydraulic press assembly collectively designated 12 mounted on the upper end of the press frame and a pair of press bars collectively designated 13 and supportable in one of two positions as will hereinafter be described.

In detail, the supporting structure 10 is preferably mounted on a supporting surface which, in the present embodiment, consists of a work bench 14 of conventional construction. However, it will be appreciated that the device can be supported upon its own bench under which circumstances caster wheels or the like may be provided so that the device is portable.

The supporting structure consists of a pair of spaced and parallel horizontally situated, outwardly facing channel members 15 and 15A having apertures 16 towards the rear ends of the lower flanges 17 for attachment to the upper surface of the work bench 14. Straps 18 may be situated on the under side of the work bench and bolt and nut assemblies 19 engage through apertures 16, through the work bench top and through the straps 18 to secure the two channel members to the bench top so that they extend forwardly therefrom as clearly illustrated in FIG. 1.

A downwardly facing channel member portion 20 is welded to the inner surfaces of the webs 21 of the channel members 15 adjacent the rear ends thereof together with vertically situated plates 22 secured on the ends of the channel section 20 and welded thereto as well as being welded to the vertically situated webs 21 of the channel members 15 and 15A.

This platform so provided, supports the press frame collectively designated 11. This press frame is in the form of an I-beam consisting of a front web 23 and a rear web 24. The front web is an angulated plate including vertical portion 25 and forwardly inclined portion 26 secured as by welding, by the bottom end thereof, centrally of the upper edge of front plate 22.

The rear web 24 also consists of a plate inclining upwardly and forwardly and terminating in a forwardly extending portion 27 and this is welded by the lower end thereof to the upper edge of the rear plate 22 and centrally thereof.

A vertically situated web plate 28 is welded by the edges thereof centrally of the plates 23 and 24 to form the upwardly and forwardly extending I-beam 11 and the hydraulic press assembly 12 is secured to the upper front end of this I-beam 11 as will hereinafter be described.

Figure 3:
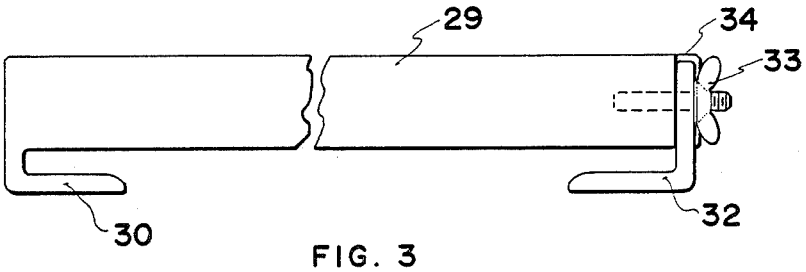
FIG. 3 is a side elevation of one of the press bars.
Figure 4:
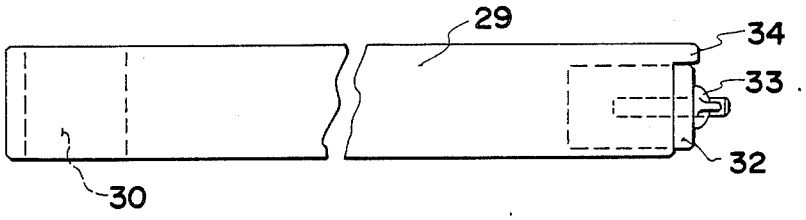
FIG. 4 is a top plan view of FIG. 3.

The aforementioned press bars 13 each consist of a bar member 29 shown in detail in FIGS. 3 and 4 and preferably being of rectangular cross-section. A hook plate 30 is welded to one end of the bars 29 and extends downwardly and then angulates inwardly as clearly shown and this hook detachably engages under the lip of the top flange 31 of one of the channel members 15.

A detachable hook 32 is secured by bolt and wing nut 33 to the other end of the bar 29 and a locating strip 34 is welded to this end of the bar in order to facilitate the positioning of the hook 32 when securing same.

These bars, with the detachable hooks 32 removed, are located upon the upper flanges of the channel members 15 and 15A whereupon the detachable hooks 32 may be secured and the bars moved back and forth in order to position same in the desired location whereupon the hook assemblies 32 may be tightened thus clamping the bars in position and preventing same from becoming displaced inadvertently.

The bars shown in solid line in FIG. 1 are in the uppermost position but, if the size of the work piece requires it, they can be placed in the lowermost position shown in phantom in FIG. 1.

In this connection, it will be noted that vertically situated front plates 35 are welded to the front ends of the channels 15 and 15A to enclose same and that these plates depend downwardly below the lower flanges 17 and a further bar 36 is welded by one end to the lower end of the plates 35 and extends rearwardly to be welded by the other end to a relatively short plate 37 welded to and depending downwardly from the bottom flange 17 of the channel members 15 and 15A just forwardly of the front edge 38 of the bench or supporting surface.

These bars 36 and the under side of the lower flanges 17 define a space 39 which is just wide enough to receive the press bars 13 which may be engaged in a reverse position with the lower flanges 17 and resting on the bars 36. This gives a second or lowermost position for the press bars 13 depending upon the operational circumstances prevailing, it being understood that they are adjustable and securable in this position in the same way as in the uppemost position.

Dealing most with the hydraulic press assembly 12, it comprises an oil or hydraulic fluid tank assembly collectively designated 40 consisting of a substantially cubicle oil tank or reservoir 41 have an upper plate 42 and a lower plate 43 welded thereto. The lower plate 43 is substantially rectangular in plan with cut away rear sides 44 and a slot 45 formed therein, said slot engaging the web or flange 28 of the I-beam 11 and being welded thereto as illustrated in FIG. 1.

The upper forward end of the flange 27 of the I-beam 11 is edge welded to the rear side 46 of the top plate 42.

Also mounted on one side of the bottom plate 43 is a pump block collectively designated 47 which carries a manually operated hydraulic pump 48 which is conventional in construction and operation.

Figure 2:
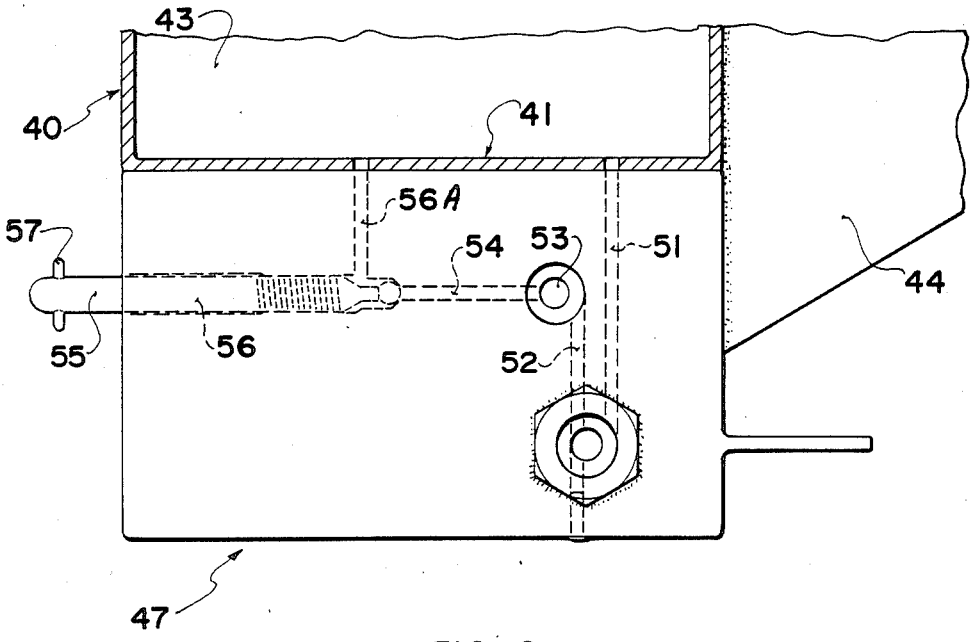
FIG. 2 is a fragmentary enlarged plan view of the pump block and part of the oil tank.

A pump operative handle 49, detachably stored on stub or spigot 50 extending upwardly from adjacent the rear of channel member 15A, is insertable within the actuating link 50A of the pump to reciprocate same in the usual manner. This pump is connected to an intake bore or drilling 51 in block 47 which in turn communicates in sealing relationship with the oil tank or reservoir 40 (see FIG. 2).

Reference character 52 illustrates a bore constituting the pressure side of the pump connected to the vertically situated pressure conduit 53 extending upwardly from the block 47.

A further block or drilling 54 communicates with a conventional release valve assembly 55 and hence via a further drilling 56A, back to the reservoir or oil tank 40 all of which is conventional in operation.

The release valve assembly 55 includes the valve stem 56 having a cross pin 57 detachable engagable by the slotted end 58 of the actuating handle 49.

The conduit 53 extends upwardly to a cross conduit 59 one end 60 of which may be closed by plug 61 or may receive a pressure gauge assembly 62 which is conventional in operation and is thus able to indicate the pressure generated by the pump 48.

This cross conduit 59 communicates with the upper end of a hydraulic jack assembly 63 also situated vertically and mounted to extend clear through the oil tank or reservoir by which it is supported. A safety relief valve assembly 64 is operatively connected to the other end of the cross conduit 59 and controls the maximum pressure generated by the pump 48. If overload occurs, this valve, which is conventional in construction, opens thus returning oil via return conduit 65, to the pump or reservoir 40 through top plate 42.

The hydraulic jack assembly 63 is substantially conventional in operation and includes a piston 66 extending below the lower plate 43. This piston is spring loaded by spring 67 extending between the top of the piston 66 and the upper end of the casing or cylinder 68 normally to return the piston to the uppermost position and it will also be noted that this piston is situated immediately above the area over which the press bars 13 are located. The piston also includes a screw threaded head 69 on the lower end thereof to give further adjustment when setting up the device for operation.

In operation, the press bars 13 are situated on the upper flanges 31 or the lower bars 36 and adjusted fore and aft as desired depending upon the operation being performed. They are then locked in place by means of the wing nut assembly 33 and the work piece is then supported thereon.

The head 69 is adjusted if necessary whereupon the actuated handle 49 is inserted within the socket end of the link 50A and the pump reciprocated in the normal way. This causes oil under pressure to enter the hydraulic jack 63 above the piston 66, moving same downwardly against the tension of the return spring 67 therein thus causing the piston 66 to move downwardly and engage the work piece as desired. If a pre-determined pressure is required, the pressure gauge 62 may be connected and observed otherwise the maximum pressure is determined by the setting of the relief valve assembly 64. When the press operation has been completed, the slotted end of the handle is engaged with the release valve 55 which is then opened thus releasing oil under pressure from the hydraulic jack assembly 63 back to the reservoir.

It will be appreciated that with the upper and lower alternative positions of the press bars and the fore and aft positioning thereof, the device is extremely versatile not only in the operation thereof but also in the size of the objects which can be placed on and/or inbetween the press bars 13 thus making the device particularly suitable for use in relatively small machine shops either on the farm or otherwise.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A hydraulic bench press for attachment to a supporting surface such as a bench; comprising in combination supporting structure, said supporting structure including a main frame consisting of a pair of spaced and parallel press bar supports having rear ends, an underside and an upper side, a press frame having an upper end which includes a front secured to adjacent said rear ends of said press bar supports and extending upwardly therefrom, a manually operated hydraulic press assembly supported upon said upper end of said press frame and a pair of press bars operatively situated across said press bar supports below said press assembly ,said hydraulic press assembly including upper and lower plates and a hydraulic fluid tank therebetween, a pump block on said lower plate, a manually operated hydraulic pump on said pump block operatively connected to said tank and to said pump, a manual release valve in said pump block, a vertically situated press head assembly having an upper end and a lower end mounted through said tank and including a piston head on the lower end thereof extending below said lower plate in operative relationship with said press bars, and a pressure relief valve assembly operatively connected to said pump and to said oil tank.

2. The bench press assembly according to claim 1 in which said press bar supports include at least two alterntive positions for detachable support of said press bars, an upper position adjacent the upper side of said supports and a lower position adjacent the under side of said supports, and means to detachably secure said press bars in either of said two positions and for varying fore and aft spaced relationship with one another along said press bar supports.

3. The bench press assembly according to claim 1 in which said press bar supports include a pair of spaced and parallel, forwardly extending channel members having rear ends, said press frame including an I-beam assembly secured between adjacent said rear ends of said channel members and extending upwardly therefrom, said hydraulic press assembly being secured to said front of the upper end of said press frame.

4. The bench press assembly according to claim 2 in which said press bar supports include a pair of spaced and parallel, forwardly extending channel members having rear ends, said press frame including an I-beam assembly secured between adjacent said rear ends of said channel members and extending upwardly therefrom, said hydraulic press assembly being secured to said front of the upper end of said press frame.

5. The bench press assembly according to claim 3 in which said piston head is provided with lower end and includes vertical adjustment means consisting of a work-piece-engaging portion screw threadably engaging said lower end of said piston head, the operative connection of said hydraulic pump to said piston head including a conduit operatively extending between said pump and said upper end of said pressure head assembly, said pressure relief valve extending from said conduit, and a pressure gauge also connected to said conduit.

6. The bench press assembly according to claim 4 in which said piston head is provided with lower end and includes vertical adjustment means consisting of a work-piece-engaging portion screw threadably engaging said lower end of said piston head, the operative connection of said hydraulic pump to said piston head including a conduit operatively extending between said pump.and said upper end of said pressure head assembly, said pressure relief valve extending from said conduit, and a pressure gauge also connected to said conduit.

7. The bench press assembly according to claim 4 in which said channel members include outwardly facing upper and lower flanges, each having one end and another end, said upper flanges constituting means to support said press bars in said upper position and horizontal flange means secured to and spaced from the lower flanges and constituting means to support said press bars in the lower position.

8. The bench press assembly according to claim 7 in which said press bars each include a transversely situated support bar having one end and another end, fixed means adjacent said one end of said each support bars to detachably secure same press bars to said upper flange of one of said channel members when in the upper position and to one of said horizontal flange means when in the lower position, and further means adjacent the other end of said each support bars to detachably secure said press bars to the other of said upper flanges of the other of said channel members when in the upper position and to the other of said horizontal flange means when in the lower position.

9. The bench press assembly according to claim 8 in which said means adjacent one end of said support bar comprises an angulated hook member engagable over the edge of said upper flange of said flange means.

10. The bench press assembly according to claim 8 in which said further means adjacent the other end of said support bars includes a hook member detachably securable to adjacent said other end and engagable under the other of said upper flanges of the other of said channel members when in the upper position and to the other of said horizontal flange means when in the lower most position.

11. The bench press assembly according to claim 1 which includes means to manually operate said hydraulic press assembly and including a detachable handle for said press assembly, and storage means on said bench press for detachably supporting said handle.

12. The bench press assembly according to claim 4 which includes means to manually operate said hydraulic press assembly and including a detachable handle for said press assembly, and storage means on said bench press for detachably supporting said handle.

13. The bench press assembly according to claim 2 which includes means to manually operate said hydraulic press assembly and including a detachable handle for said press assembly, and storage means on said bench press for detachably supporting said handle.

14. The bench press assembly according to claim 3 which includes means to manually operate said hydraulic press assembly and including a detachable handle for said press assembly, and storage means on said bench press for detachably supporting said handle.

15. The bench press assembly according to claims 7 which includes means to manually operate said hydraulic press assembly and including a detachable handle for said press assembly, and storage means on said bench press for detachably supporting said handle.

16. The bench press assembly according to claim 8 which includes means to manually operate said hydraulic press assembly and including a detachable handle for said press assembly, and storage means on said bench press for detachably supporting said handle.

17. The bench press assembly according to claim 9 which includes means to manually operate said hydraulic press assembly and including a detachable handle for said press assembly, and storage means on said bench press for detachably supporting said handle.

18. The bench press assembly according to claim 10 which includes means to manually operate said hydraulic press assembly and including a detachable handle for said press assembly, and storage means on said bench press for detachably supporting said handle.

19. The bench press assembly according to claim 1 in which said piston head is provided with a lower end and includes vertical adjustment means consisting of a work-piece-engaging portion screw threadably engaging said lower end of said piston head, the operative connection of said hydraulic pump to said piston head including a conduit operatively extending between said pump and said upper end of said pressure head assembly, said pressure relief valve extending from said conduit, and a pressure gauge also connected to said conduit.

20. The bench press assembly according to claim 2 in which said piston head is provided with a lower end and includes vertical adjustment means consisting of a work-piece-engaging portion screw threadably engaging said lower end of said piston head, the operative connection of said hydraulic pump to said piston head including a conduit operatively extending between said pump and said upper end of said pressure head assembly, said pressure relief valve extending from said conduit, and a pressure gauge also connected to said conduit.

* * * * *